US005839727A

United States Patent [19]

Stillinger

[11] Patent Number: 5,839,727

[45] **Date of Patent: *Nov. 24, 1998**

[54] GAME AND A METHOD OF PLAYING A BOARD GAME

[76] Inventor: Douglas S. Stillinger, 15360 Robin Ann La., Monte Sereno, Calif. 95030

[ * ] Notice: The terminal 13 months of this patent has been disclaimed.

[21] Appl. No.: 322,230

[22] Filed: Oct. 13, 1994

[51] Int. Cl.[6] ..... A63F 3/00

[52] U.S. Cl. ..... 273/271; 273/260; 273/275; 273/290

[58] Field of Search ..... 273/248, 258, 273/260, 261, 264, 271, 275, 276, 290

[56] References Cited

U.S. PATENT DOCUMENTS

| | | | |
|---|---|---|---|
| 3,806,125 | 4/1974 | Bialek | 273/290 |
| 4,696,476 | 9/1987 | Eplett | 273/287 |
| 4,776,597 | 10/1988 | Rudell | 273/290 |
| 5,328,188 | 7/1994 | Brotz | 273/290 |

*Primary Examiner*—Jessica J. Harrison
*Assistant Examiner*—William M. Pierce

[57] ABSTRACT

The invented game includes a playing field with a pattern of defined areas adjacent to one another, sets of playing pieces for each player, and a single marking piece which is several times the height of a playing piece. The playing pieces are configured such that they are stackable on top of one another and such that a stack can be inverted. The game is played by a first player placing the marking piece on any defined area. The next player then places one of his playing pieces on any other defined area. The next player places one of his playing pieces on any unoccupied area or stacks his playing piece on the playing piece already on the playing field. Each player then, in turn, either places a playing piece on an unoccupied area, stacks a playing piece on top of another playing piece or on top of an existing stack of playing pieces, or inverts an existing stack of playing pieces. The object of the game is for each player to build a series of adjacent stacks each with the top piece from his set of pieces and with each stack being either one piece higher, one piece lower or the same height as adjacent stacks. This series must reach the height of the marking piece at an area adjacent to the marking piece.

9 Claims, 2 Drawing Sheets

GAME AND A METHOD OF PLAYING A BOARD GAME

FIELD OF THE INVENTION

This invention relates to a method of playing a board game by two or more players for amusement.

BACKGROUND OF THE INVENTION

Various types of board games have been devised utilizing a playing board and playing pieces. These include the classic games of Chess, Checkers, and Go. Board games, in general, provide for and require strategic thinking to play. The differing rules and objectives of the games require different types of strategic thinking.

It would be desirable to provide a new game and method of play which would provide new and different strategies. Such a game should also be easy to learn and simple to play yet can be played at many different skill levels. Such a game should also be inexpensive, portable, durable, and played by two or more people.

SUMMARY OF THE INVENTION

The improved board game and method of play of the present invention satisfy all of the foregoing needs. The game includes a game board or playing field with a pattern of defined areas adjacent to one another, sets of playing pieces for each player, and a single marking piece which is several times the height of a playing piece. The playing pieces are configured such that they are stackable on top of one another and such that a stack can be inverted. In one embodiment of my invention play begins with the first player placing the marking piece on any defined area. The next player then places one of his playing pieces on any other defined area. The next player places one of his playing pieces on any unoccupied area or stacks his playing piece on the playing piece already on the playing field. Each player then, in turn, either places a playing piece on an unoccupied area, stacks a playing piece on top of another playing piece or on top of an existing stack of playing pieces, or inverts an existing stack of playing pieces. The object of the game is for each player to build a chain or series of adjacent stacks each with the top piece from his set of pieces and with each stack being either one piece higher, one piece lower or the same height as adjacent stacks. This series must reach the height of the marking piece at an area adjacent to the marking piece.

DETAILED DESCRIPTION AND BEST MODE FOR CARRYING OUT THE INVENTION

Figure 1:
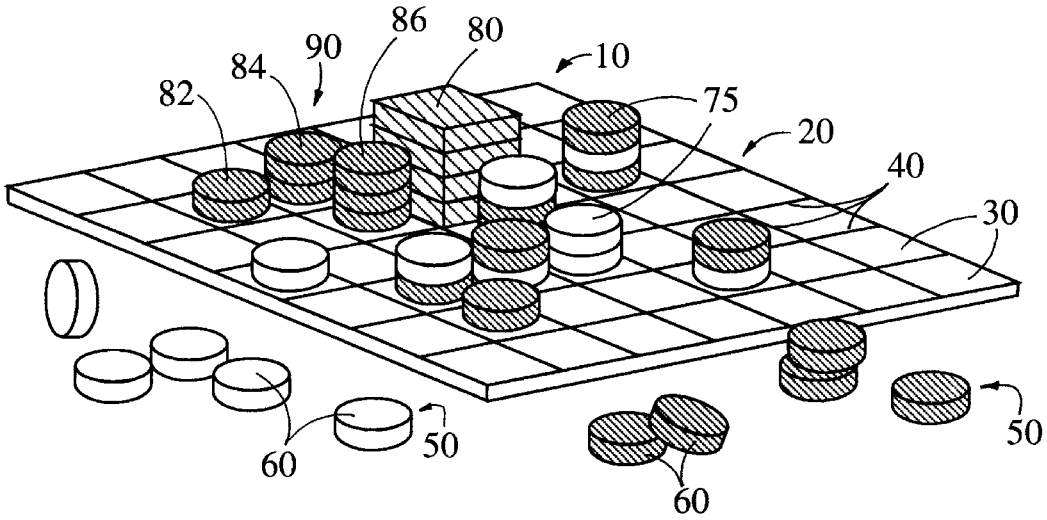
FIG. 1 shows one embodiment of the invented game, including a square game board along with two sets of playing pieces and a single marking piece. The marking piece and playing pieces are shown positioned on the game board as they might be in a typical game.

FIG. 1 shows a game 10 which includes a flat game board or playing field 20. Playing field 20 may be made of wood, plastic, metal, cardboard, or the like. The playing field is divided into adjacent defined areas like those shown at 30, which are defined by horizontal and vertical intersecting lines 40. In this embodiment, the game board 20 is square and has seven defined areas horizontally and seven defined areas vertically for a total of forty-nine defined areas. Each defined area 30 has several adjacent defined areas which are those defined areas which share a common line as a border.

Figure 2:
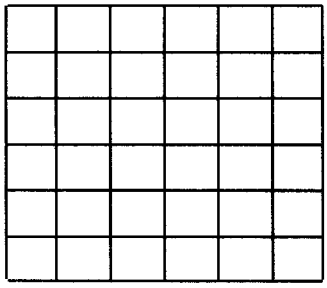
FIG. 2, FIG. 3, and FIG. 4 depict alternate game board configurations.
Figure 3:
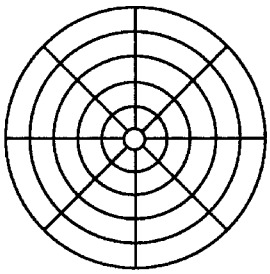
Figure 4:
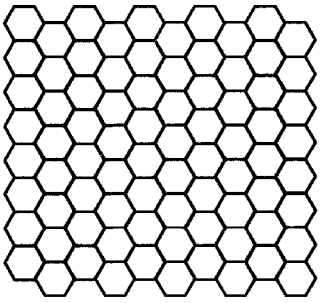

Of course, the playing field may take many different configurations. FIG. 2 shows a playing field where the defined areas are squares, but where there are only thirty-six defined areas. FIG. 3 shows another playing field having an overall circular shape with concentric circles and radiating lines defining the areas. FIG. 4 shows a group of hexagons defining a playing field. The defined areas in a playing field may also be configured so that there are spaces between the areas. Nonetheless, areas near one another may still be thought of as adjacent.

Figure 5:
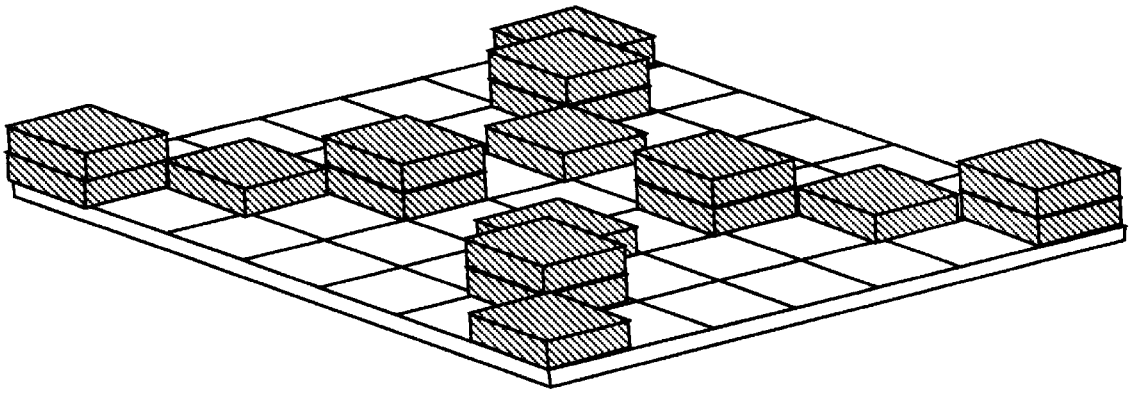
FIG. 5 shows another alternate game board configuration.

The playing field may also have defined areas at different elevations, as shown in FIG. 5. The different elevations will change the height of stacks of playing pieces. That modification would add a different dimension to the game, as will be evident after reading the discussion below concerning how the game is played.

The playing field may also have regions wherein there are no defined areas. In other words, the playing field may include areas into which no playing piece may be placed.

Game 10 also contains a plurality of sets 50, of a plurality of playing pieces 60. Each playing piece 60 of each set 50 bears indicia which identify it as a member of its set and which distinguish it from the other sets. For example, each set 50 can be of a different color or shape from the other sets.

Figure 6:
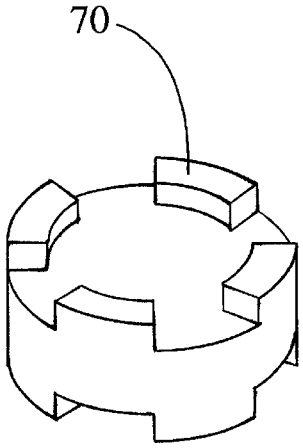
FIG. 6 depicts a playing piece with interlockable elements.

FIG. 6 shows that each playing piece 60 may have interlocking features 70 such that one playing piece can be stacked on top of another and substantially held in place so that the top piece cannot easily slide off of the lower piece. The result is a stack 75 of playing pieces. Each playing piece 60 must at least include a top surface and a bottom surface so that it may be stacked on any other playing piece both from its own set and other sets. The playing pieces 60 are sized to fit comfortably within the defined areas 30 on the playing field 20. Each playing piece is also a uniform and predetermined height or width.

One embodiment of game 10 also includes a marking piece 80. The height of this piece is preferably a multiple of the height of a playing piece 60, for example it may be three or four times the height of a playing piece 60. The marking piece is sized to fit comfortable within the defined areas 30 of the playing field 20.

My invented game is played by a first player, chosen in some random method, placing the marking piece 80 on any defined area 30 on the game board 20. A second player then places one of his playing pieces 60 from his set 50 on any other defined area 30. The players then take turns in a selected order. If there are only two players, it is the first players turn again. If there are three players, then it is the third player's turn.

The next player has the option to do one of two plays. First, he can place one of his playing pieces on any empty defined area 30. Second, he can place one of his playing pieces on top of the other playing piece already on the playing field, thus forming a stack, as shown for example at 75. The next player, and each subsequent player, has several options. He can place a playing piece on an unoccupied area, he can place a playing piece on another piece to form a stack, he can place a playing piece on an existing stack thus adding to the height of the stack, or he can invert or flip over an existing stack 75 so that the bottom playing piece now becomes the top playing piece of that stack.

The object of game 10 is to build a winning chain or series 90 of stacks 75 and playing pieces 60 which climb to the height of the marking piece 80. A chain is a series of stacks and playing pieces which occupy defined and adjacent areas. A winning chain must meet several criteria. First, it must consist of stacks on defined areas which are adjacent to the ones before and after them in the series. Adjacent may or may not include areas diagonally next to each other, depending on the desires of the players. Second, the top playing piece of each stack in the series must be from the same set of playing pieces. Third, each stack in the chain must either be one playing piece higher, one playing piece lower or the same height as its adjacent stacks. And fourth, the chain must reach the height of the marking piece at a defined area adjacent to the marking piece. The first player to build a winning chain is the winner of the game. An example of a winning chain is shown by stacks 82, 84 and 86 in FIG. 1.

As is evident, inverting a stack will affect the chain or series of stacks. Additionally, a playing field of elevated areas will also affect the series.

My invention may also be played without the marking piece. In that embodiment, the players would each compete to form a series of stacks where one stack at the end of a series reaches a predetermined number of playing pieces in height.

INDUSTRIAL APPLICABILITY

This invention is applicable to the toy, game and entertainment industries. While several embodiments of my invention have been disclosed, changes may be made without departing from the spirit of the invention.

I claim:

1. A method of playing a game on a playing field having a pattern of adjacent defined areas, where the game is played by at least two players, each player having a distinguishable set of a plurality of playing pieces, the method comprising:

a first player placing a first playing piece from a first set of playing pieces on a defined area in the playing field, a second player placing a first playing piece from a second set of playing pieces on any defined area in the playing field unoccupied by the first playing piece of the first player, or the second player stacking the first playing piece from the second set of playing pieces on the first playing piece of the first player, thus creating a stack of playing pieces, continuing play by each player in turn either placing a playing piece from that player's respective first or second set of playing pieces on a defined area unoccupied by another playing piece, stacking the playing piece on another playing piece already placed on a defined area, or stacking the playing piece on an existing stack of playing pieces, repeating the step of continuing play until a series of a predetermined number of stacks is formed, where each stack in the series is adjacent at least one other stack in the series, where the top playing piece in each stack is from the same set of playing pieces, and where each stack in the series consists of one playing piece more or one playing piece less or the same number of playing pieces as each other stack to which it is adjacent, at which time the player whose set of playing pieces is on the top of each stack in the series is declared the winner.

2. The method of claim 1 wherein the step of continuing play includes the option of inverting an existing stack of playing pieces.

3. The method of claim 1 wherein the defined areas are adjacent squares.

4. The method of claim 1 wherein the defined areas are adjacent hexagons.

5. The method of claim 1 further comprising the step of providing a marking piece, and placing the marking piece on a defined area on the playing field, and where the series of a predetermined number of stacks includes an end stack in a defined area adjacent to the marking piece.

6. The method of claim 5 wherein the marking piece has a height equal to a predetermined number of playing pieces, and where the end stack has a height equal to one playing piece more or one playing piece less or the same number of playing pieces as the height of the marking piece.

7. The method of claim 5 wherein the step of placing the marking piece on any defined area on the playing field is prior to the step of a first player placing a first playing piece.

8. The method of claim 5 wherein the step of placing the marking piece on a defined area on the playing field is prior to the step of a first player placing a first playing piece.

9. The method of claim 5 wherein the specified area is in the center of the playing field.

* * * * *